US008814600B2

(12) United States Patent
Watanabe

(10) Patent No.: US 8,814,600 B2
(45) Date of Patent: Aug. 26, 2014

(54) CONNECTION JACK AND ELECTRONIC APPARATUS

(75) Inventor: Yasuhito Watanabe, Aichi (JP)

(73) Assignee: Sony Corporation (JP)

( * ) Notice: Subject to any disclaimer, the term of this patent is extended or adjusted under 35 U.S.C. 154(b) by 89 days.

(21) Appl. No.: 13/572,940

(22) Filed: Aug. 13, 2012

(65) Prior Publication Data

US 2013/0052870 A1 Feb. 28, 2013

(30) Foreign Application Priority Data

Aug. 22, 2011 (JP) ..... 2011-180874

(51) Int. Cl.
*H01R 13/66* (2006.01)

(52) U.S. Cl.
USPC ..... 439/620.09; 439/669

(58) Field of Classification Search
USPC ..... 439/620.09, 620.11, 668, 669, 675, 439/660, 924.1, 924.2
See application file for complete search history.

(56) References Cited

U.S. PATENT DOCUMENTS 4,420,216 A * 12/1983 Motoyama et al. ..... 439/188
6,126,465 A * 10/2000 Franks, Jr. ..... 439/218
6,869,316 B2 * 3/2005 Hinkle et al. ..... 439/675
7,727,029 B2 * 6/2010 Bolin et al. ..... 439/669
7,883,358 B1 * 2/2011 Chu et al. ..... 439/489
8,464,078 B2 * 6/2013 Brooks et al. ..... 713/300
2003/0119368 A1 * 6/2003 Li et al. ..... 439/668
2006/0234562 A1 * 10/2006 Lin ..... 439/668

FOREIGN PATENT DOCUMENTS

JP 2006-278118 A 10/2006

* cited by examiner

*Primary Examiner* — Hae Moon Hyeon

(74) *Attorney, Agent, or Firm* — Lerner, David, Littenberg, Krumholz & Mentlik, LLP

(57) ABSTRACT

A connection jack to which a connection plug having a center terminal and an earth terminal arranged on an outer peripheral side of the center terminal is connected and provided in an electronic apparatus in which a capacitor is disposed inside, includes: a housing made of an insulating material, in which an insertion opening to which the connection plug is inserted is formed; a center electrode to which the center terminal is connected and connected to the capacitor; a first earth electrode arranged on an outer peripheral side of the center electrode, to which the earth terminal is connected, and connected to the capacitor; and a second earth electrode arranged on an outer peripheral side of the center electrode, to which the earth terminal is connected, connected in series to a resistance limiting inrush current and connected to the capacitor through the resistance.

6 Claims, 6 Drawing Sheets

CONNECTION JACK AND ELECTRONIC APPARATUS

CROSS-REFERENCE TO RELATED APPLICATION

The present application claims priority from Japanese Patent Application No. JP 2011-180874 filed in the Japanese Patent Office on Aug. 22, 2011, the entire content of which is incorporated herein by reference.

FIELD

The present disclosure relates to a connection jack and an electronic apparatus. Particularly, the present disclosure relates to a technical field in which an earth electrode connected in series to a resistance for limiting inrush current is provided to thereby prevent inrush current from occurring when a connection plug is connected while reducing manufacturing costs and so on.

BACKGROUND

There exist various electronic apparatuses provided with a connection jack (DC jack) to which a connection plug is (DC plug) is connected, for example, a recording/reproducing apparatus performing recording and reproduction of images and audio, an acoustic apparatus performing output of audio and so on, an imaging apparatus performing imaging of images and video, a network communication apparatus performing various communication, and information processing apparatuses such as a personal computer and a PDA (Personal Digital Assistant) (for example, see JP-A-2006-278118 (Patent Document 1)).

The connection jack includes a center electrode and an earth electrode arranged at an outer periphery of the center electrode, and respective electrodes are connected to a capacitor and an electronic circuit arranged inside the electronic apparatus.

On the other hand, the connection plug is connected to an AC adapter connected to a power supply plug and the power supply plug is connected to commercial power, thereby supplying DC current converted by the AC adapter to the connection plug. The connection plug includes a center terminal to be connected to the center electrode of the connection jack and an earth terminal arranged at an outer peripheral side of the center terminal and connected to the earth electrode of the connection jack.

When the connection plug is connected to the connection jack, DC current is supplied from the connection plug to the capacitor to be charged, and respective units of the electronic circuit are driven by rated current.

SUMMARY

When the power supply plug is connected to the commercial power in advance in the electronic apparatus having the above connection jack, DC current is supplied to the connection plug. If the connection plug is connected to the connection jack in this state, electric current having a much higher current value than current flowing at the time of driving the electric apparatus flows from the connection jack toward the capacitor as inrush current.

If such inrush current flows, sparks occur at the connection jack and a contact is melted due to sparks. Then, performance deterioration such as increase of contact resistance occurs and there is a danger that problems such as burnout are caused at the time of driving the electronic apparatus.

Additionally, user may feel uneasy or intimidated due to sound of sparks generated when sparks occur.

In response to the above, there exists a related-art electronic apparatus which includes an inrush-current limiter for preventing occurrence of inrush current between the connection jack and the capacitor. The inrush-current limiter is provided with plural resistances and a FET (Field Effect Transistor) switch for bypassing the resistance when voltage is increased. Current is limited by the resistance just after the connection plug is connected to the connection jack, and the resistance is bypassed by the FET switch when voltage is increased, thereby preventing occurrence of inrush current.

However, in the related-art electronic apparatus having the above inrush-current limiter, as it is necessary to provide the FET switch in addition to plural resistances in the inrush-current limiter, there is a problem that manufacturing costs are high due to the increase of the number of components.

Additionally, as the inrush-current limiter occupies a large area in a circuit substrate arranged inside the electronic apparatus, there is also a problem that the electronic apparatus becomes large in size.

In view of the above, it is desirable that the connection jack and the electronic apparatus according to an embodiment of the present disclosure solve the above problems and prevent occurrence of inrush current while reducing manufacturing costs and downsizing the apparatus.

An embodiment of the present disclosure is directed to a connection jack to which a connection plug having a center terminal and an earth terminal arranged on an outer peripheral side of the center terminal is connected and provided in an electronic apparatus in which a capacitor is disposed inside, which includes a housing made of an insulating material, in which an insertion opening to which the connection plug is inserted is formed, a center electrode to which the center terminal is connected and connected to the capacitor, a first earth electrode arranged on an outer peripheral side of the center electrode, to which the earth terminal is connected, and connected to the capacitor, and a second earth electrode arranged on an outer peripheral side of the center electrode, to which the earth terminal is connected, connected in series to a resistance limiting inrush current and connected to the capacitor through the resistance, in which the first earth electrode and the second earth electrode are arranged at positions where the earth terminal is connected to the second earth electrode before the earth terminal is connected to the first earth electrode at the time of connecting the connection plug.

Accordingly, after the earth terminal is connected to the second earth electrode and electric current is supplied to the capacitor through the resistance, the earth terminal is connected to the first earth electrode and the resistance is bypassed to thereby supply electric current to the capacitor in the connection jack.

In the embodiment of the present disclosure, it is preferable that the connection jack is provided with a protection device for protecting the resistance, which suppresses heat generation in the resistance generated when the center terminal is connected to the center electrode and the earth terminal is connected to the second earth electrode in a state where the earth terminal is not connected to the first earth electrode.

As the protection device for protecting the resistance is provided, which suppresses heat generation in the resistance generated when the center terminal is connected to the center electrode and the earth terminal is connected to the second earth electrode in a state where the earth terminal is not connected to the first earth electrode, the supply of electric current to the resistance is interrupted by the protection device and excessive heat generation in the resistance can be prevented.

In the embodiment of the present disclosure, it is preferable that the first earth electrode and the second earth electrode can be elastically deformed and that the first earth electrode and the second earth electrode are connected to the earth terminal in a state of being pushed thereon due to elasticity in the above connection jack.

As the first earth electrode and the second earth electrode can be elastically deformed, and the first earth electrode and the second earth electrode are connected to the earth terminal in the state of being pushed thereon due to elasticity, the first earth electrode and the second earth electrode follow the displacement of the earth terminal.

In the embodiment of the present disclosure, it is preferable that the first earth electrode and the second earth electrode are arranged 180 degrees opposite to each other so as to sandwich the center electrode in the above connection jack.

As the first earth electrode and the second earth electrode are arranged 180 degrees opposite to each other so as to sandwich the center electrode, the first earth electrode and the second earth electrode are connected to the earth terminal from opposite sides so as to sandwich the center thereof.

In the embodiment of the present disclosure, it is preferable that the second earth electrode and the center electrode are arranged at positions where the center terminal is connected to the center electrode before the earth terminal is connected to the second earth electrode at the time of connecting the connection plug in the above connection jack.

As the second earth electrode and the center electrode are arranged at positions where the center terminal is connected to the center electrode before the earth terminal is connected to the second earth electrode at the time of connecting the connection plug, the central axis of the earth terminal is not displaced with respect to the central axis of the center electrode in the radial direction when the earth terminal is connected to the first earth electrode and the second earth electrode.

Another embodiment of the present disclosure is directed to an electronic apparatus including a casing in which a capacitor and an electronic circuit is arranged inside, and a connection jack to which a connection plug having a center terminal and an earth terminal arranged on an outer peripheral side of the center terminal is connected, in which the connection jack includes a housing made of an insulating material, in which an insertion opening to which the connection plug is inserted is formed, a center electrode to which the center terminal is connected and connected to the capacitor, a first earth electrode arranged on an outer peripheral side of the center electrode, to which the earth terminal is connected, and connected to the capacitor, and a second earth electrode arranged on an outer peripheral side of the center electrode, to which the earth terminal is connected, connected in series to a resistance limiting inrush current and connected to the capacitor through the resistance, in which the first earth electrode and the second earth electrode are arranged at positions where the earth terminal is connected to the second earth electrode before the earth terminal is connected to the first earth electrode at the time of connecting the connection plug.

Accordingly, after the earth terminal is connected to the second earth electrode and electric current is supplied to the capacitor through the resistance, the earth terminal is connected to the first earth electrode and the resistance is bypassed to thereby supply electric current to the capacitor in the electronic apparatus.

The connection jack according to the embodiment of the present disclosure to which the connection plug having the center terminal and the earth terminal arranged on the outer peripheral side of the center terminal is connected is provided in the electronic apparatus in which the capacitor is disposed inside, which includes the housing made of the insulating material, in which the insertion opening to which the connection plug is inserted is formed, the center electrode to which the center terminal is connected and connected to the capacitor, the first earth electrode arranged the outer peripheral side of the center electrode, to which the earth terminal is connected and connected to the capacitor, and the second earth electrode arranged on the outer peripheral side of the center electrode, to which the earth terminal is connected, connected in series to a resistance limiting inrush current and connected to the capacitor through the resistance, in which the first earth electrode and the second earth electrode are arranged at positions where the earth terminal is connected to the second earth electrode before the earth terminal is connected to the first earth electrode at the time of connecting the connection plug.

Accordingly, it is not necessary to provide a inrush-current limiter with a large number of components including a switch in addition to resistances and having high manufacturing costs, therefore, generation of inrush current can be prevented while reducing manufacturing costs and downsizing the apparatus.

In the embodiment of the present disclosure, the protection device for protecting the resistance is provided, which suppresses heat generation in the resistance generated when the center terminal is connected to the center electrode and the earth terminal is connected to the second earth electrode in the state where the earth terminal is not connected to the first earth electrode.

Accordingly, it is not necessary to use a large-capacity resistance withstanding a high heating value and the resistance withstanding a low heating value can be used, thereby reducing manufacturing costs.

In the embodiment of the present disclosure, the first earth electrode and the second earth electrode can be elastically deformed, and the first earth electrode and the second earth electrode are connected to the earth terminal in the state of being pushed thereon due to elasticity.

Accordingly, a good connection state of the earth terminal with respect to the first earth electrode and the second earth electrode can be secured.

In the embodiment of the present disclosure, the first earth electrode and the second earth electrode are arranged 180 degrees opposite to each other so as to sandwich the center electrode.

Accordingly, the first earth electrode and the second earth electrode are connected to the earth terminal from opposite sides so as to sandwich the center thereof, and the connection state of the connection plug with respect to the connection jack can be stabilized.

In the embodiment of the present disclosure, the second earth electrode and the center electrode are arranged at positions where the center terminal is connected to the center electrode before the earth terminal is connected to the second earth electrode at the time of connecting the connection plug.

Accordingly, the central axis of the earth terminal is not displaced with respect to the central axis of the center electrode in the radial direction when the earth terminal is connected to the first earth electrode and the second earth electrode, as a result, the earth terminal can be positively connected to the first earth electrode and the second earth electrode.

The electronic apparatus according to the embodiment of the present disclosure includes the casing in which a capacitor and an electronic circuit is arranged inside and the connection jack to which the connection plug having the center terminal and the earth terminal arranged on the outer peripheral side of the center terminal is connected, in which the connection jack includes the housing made of the insulating material, in which the insertion opening to which the connection plug is inserted is formed, the center electrode to which the center terminal is connected and connected to the capacitor, the first earth electrode arranged on the outer peripheral side of the center electrode, to which the earth terminal is connected, and connected to the capacitor, and the second earth electrode arranged on an outer peripheral side of the center electrode, to which the earth terminal is connected, connected in series to the resistance limiting inrush current and connected to the capacitor through the resistance, in which the first earth electrode and the second earth electrode are arranged at positions where the earth terminal is connected to the second earth electrode before the earth terminal is connected to the first earth electrode at the time of connecting the connection plug.

Accordingly, it is not necessary to provide the inrush-current limiter with a large number of components including the switches in addition to the resistances and having high manufacturing costs, therefore, generation of inrush current can be prevented while reducing manufacturing costs and downsizing the apparatus.

DETAILED DESCRIPTION

Hereinafter, a connection jack and an electronic apparatus according to an embodiment of the present disclosure will be explained with reference to the attached drawings.

In the following explanation, directions of front, back, up, down, right and left are indicated by determining a direction in which a connection plug is inserted into the connection jack when the connection plug is connected to the connection jack as a backward direction. The directions of front, back, up, down, right and left are used for convenience of explanation, and directions are not limited to these directions when carrying out the present disclosure.

[Schematic Structure of Power Supply Device]

First, a power supply device 100 having a connection plug to be connected to a connection jack will be explained (see FIG. 1 and FIG. 2).

Figure 1:
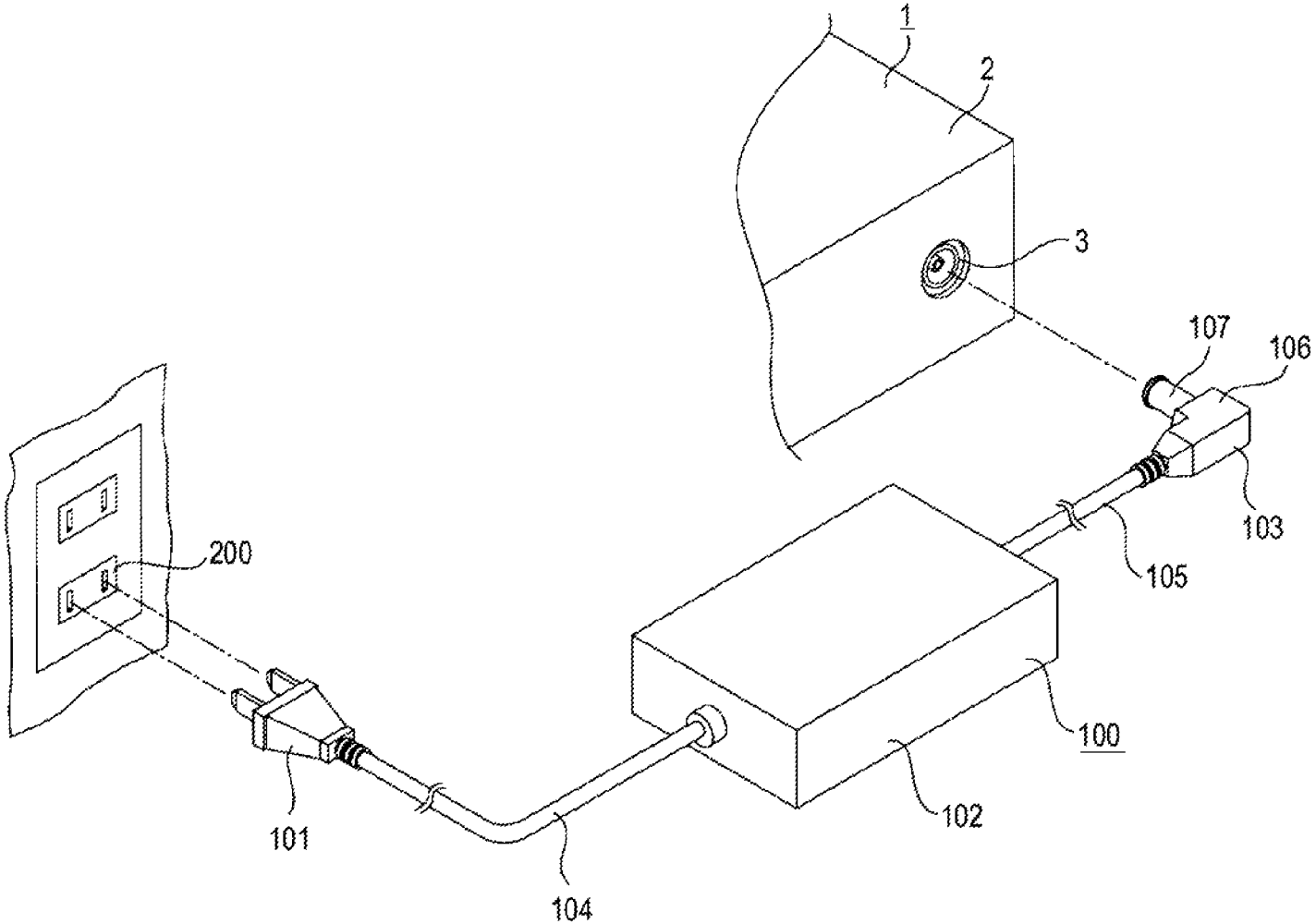
FIG. 1 shows a connection jack and an electronic apparatus according to an embodiment of the present disclosure together with FIG. 2 to FIG. 6, which is a perspective view showing part of the electronic apparatus and a power supply device.

The power supply device 100 includes a power supply plug 101, an AC adapter 102 and a connection plug 103 (see FIG. 1).

The power supply plug 101 is connected to a plug socket 200 to which commercial power is supplied. The power supply plug 101 is connected to the AC adapter 102 through a first connection code 104.

The AC adapter 102 is an adapter for converting AC current supplied from the power supply plug 101 connected to the plug socket 200 into DC current.

The connection plug 103 is connected to the AC adapter 102 through a second connection code 105. The connection plug 103 includes a holding base 106 made of an insulating material and a connection terminal 107 made of a conductive material (see FIG. 2).

The holding base 106 includes a housing portion 108 and a holding protrusion 109 protruding backward from the housing portion 108. The holding protrusion 109 is formed to have an approximately cylindrical shape, including a flange portion 109*a* protruding outward at a tip portion (back end portion).

The connection terminal 107 includes a center terminal 110 protruding backward and an earth terminal 111 arranged at an outer peripheral side of the center terminal 110.

The center terminal 110 is formed to have an approximately cylindrical shape with a small diameter, in which a central axis thereof corresponds to a central axis of the holding protrusion 109. A center hole of the center terminal 110 is formed as a connection hole 110*a*.

The earth terminal 111 is formed to have a cylindrical shape having a larger diameter than the center terminal 110, in which a central axis corresponds to the central axis of the center terminal 110. The earth terminal 111 is fit onto an outer peripheral side of a portion other than the flange portion 109*a* in the holding protrusion 109. A back end of the earth terminal 111 is positioned backward with respect to a back end of the center terminal 110.

[Schematic Structure of Electronic Apparatus]

Next, an electronic apparatus 1 in which the connection jack is provided will be explained (see FIG. 1 to FIG. 3).

The electronic apparatus 1 is configured by arranging necessary respective components in and out of a casing 2 (see FIG. 1). The electronic apparatus 1 is, for example, a recording/reproducing apparatus performing recording and reproduction of images and audio, an acoustic apparatus performing output of audio and so on, an imaging apparatus performing imaging of images and video, a network communication apparatus performing various communication, or an information processing apparatus such as a personal computer or a PDA (Personal Digital Assistant).

A not-shown electronic circuit is arranged inside the casing 2. The electronic circuit is a circuit having control over the entire electronic apparatus 1, including given electronic components such as a CPU (Central Processing Unit).

The casing 2 is provided with the connection jack 3 to which the connection plug 103 is connected. The connection jack 3 includes a housing 4 made of an insulating material and a connection electrode 5 held in the housing 4 and made of a conductive material (see FIG. 3).

The housing 4 includes an inner cylindrical portion 6 and an outer cylindrical portion 7.

The inner cylindrical portion 6 has a center portion 8 formed to have an approximately cylindrical shape extending in a front and back direction and a presser portion protruding outward in a radial direction from an outer peripheral surface of the center portion 8. A center hole of the center portion 8 is formed as an insertion arrangement hole 8*a*.

The outer cylindrical portion 7 includes a cylindrical outer peripheral portion 10, an inner protrusion protruding inward from a back end portion of the cylindrical outer peripheral portion 10 and an inner peripheral portion 12 protruding forward from an inner end of the inner protrusion 11. A given gap is formed between an inner peripheral surface of the outer peripheral portion 10 and an outer surface of the presser portion 9, and cylindrical space is formed between an inner peripheral surface of the inner peripheral portion 12 and the outer peripheral surface of the center portion 8.

A central axis of the outer cylindrical portion 7 corresponds to a central axis of the center portion 8. An opening in the front side of the inner peripheral portion 12 of the outer cylindrical portion 7 is formed as an insertion opening 12*a* into which the connection plug 103 is inserted. A front end of the inner peripheral portion 12 is positioned forward with respect to a front end of the center portion 8.

A detection terminal 13 is arranged on an outer peripheral side of the center portion 8 of the inner cylindrical portion 6. The detection terminal 13 is positioned just outside a back end portion of the center portion 8 and is connected to a not-shown detection unit detecting a connection state of the connection plug 103 with respect to the connection jack 3.

The connection electrode 5 includes a center electrode 14, a first earth electrode 15 and a second earth electrode 16.

The center electrode 14 includes a connection portion 14*a* arranged so as to be inserted into the center portion 8 of the inner cylindrical portion 6 and a tab portion 14*b* folded with respect to the connection portion 14*a* and positioned outside the center portion 8. The connection portion 14*a* is arranged in the insertion arrangement hole 8*a* so that a central axis thereof corresponds to the central axis of the center portion 8.

The first earth electrode 15 is arranged on an outer peripheral side of the connection portion 14*a* of the center electrode 14, including an inner arrangement portion 17 arranged inside the outer peripheral portion 10 and a tab portion 18 continued from the inner arrangement portion 17 and positioned outside the outer peripheral portion 10.

The inner arrangement portion 17 is configured so that a first attached portion 17*a*, a second attached portion 17*b*, a first inclined portion 17*c*, a second inclined portion 17*d* and a contact terminal portion 17*e* are sequentially connected.

The first attached portion 17*a* extends in the front and back direction and attached on an inner peripheral surface of the outer peripheral portion 10. The second attached portion 17*b* is continued from a front end portion of the first attached portion 17*a* so as to be folded 90 degrees with respect to the first attached portion 17*a* and attached on an inner surface of the inner protrusion 11. The first inclined portion 17*c* is continued from an inner end portion of the second attached portion 17*b* and inclined so as to be close to the center portion 8 as extending backward. The second inclined portion 17*d* is continued from a back end portion of the first inclined portion 17*c* and inclined so as to be apart from the center portion 8 as extending backward. The contact terminal portion 17*e* is continued from a back end portion of the second inclined portion 17*d* and connected to the detection terminal 13 in a state where the connection plug 103 is not connected to the connection jack 3. A portion where the first inclined portion 17*c* is connected to the second inclined portion 17*d* is provided as a contact portion 17*f*.

In the first earth electrode 15, the first inclined portion 17*c*, the second inclined portion 17*d* and the contact terminal portion 17*e* can be elastically deformed with respect to other portions, and the contact portion 17*f* is displaced in a separating/approaching direction with respect to the outer peripheral surface of the center portion 8 when elastically deformed.

The second earth electrode 16 is arranged on an outer peripheral side of the connection portion 14*a* of the center electrode 14, including an inner arrangement portion 19 arranged inside the outer peripheral portion 10 and a tab portion 20 continued from the inner arrangement portion 19 and positioned outside the outer peripheral portion 10. The second earth electrode 16 is arranged 180 degrees opposite to the first earth electrode 15 so as to sandwich the center electrode 14.

The inner arrangement portion 19 is configured so that a first attached portion 19*a*, a second attached portion 19*b*, a first inclined portion 19*c*, a second inclined portion 19*d* and a tip portion 19*e* are sequentially connected.

The first attached portion 19*a* extends in the front and back direction and attached on an inner peripheral surface of the outer peripheral portion 10, which is arranged in a state where part thereof is inserted into the gap formed between the inner peripheral surface of the outer peripheral portion 10 and the outer surface of the presser portion 9. The second attached portion 19*b* is continued from a front end of the first attached portion 19*a* so as to be folded 90 degrees with respect to the first attached portion 19*a* and attached on an inner surface of the inner protrusion 11. The first inclined portion 19*c* is continued from an inner end portion of the second attached portion 19*b* and inclined so as to be close to the center portion 8 as extending backward. The second inclined portion 19*d* is continued from a back end portion of the first inclined portion 19*c* and inclined so as to be apart from the center portion 8 as extending backward. The tip portion 19*e* extends forward and backward and connected to a back end portion of the second inclined portion 19*d*. A portion where the first inclined portion 19*c* is connected to the second inclined portion 19*d* is provided as a contact portion 19*f*.

The contact portion 19*f* of the second earth electrode 16 is positioned forward with respect to the contact portion 17*f* of the first earth electrode 15.

In the second earth electrode 16, the first inclined portion 19*c*, the second inclined portion 19*d* and the tip portion 19*e* can be elastically deformed with respect to other portions, and the contact portion 19*f* is displaced in the separating/approaching direction with respect to the outer peripheral surface of the center portion 8 when elastically deformed.

Figure 2:
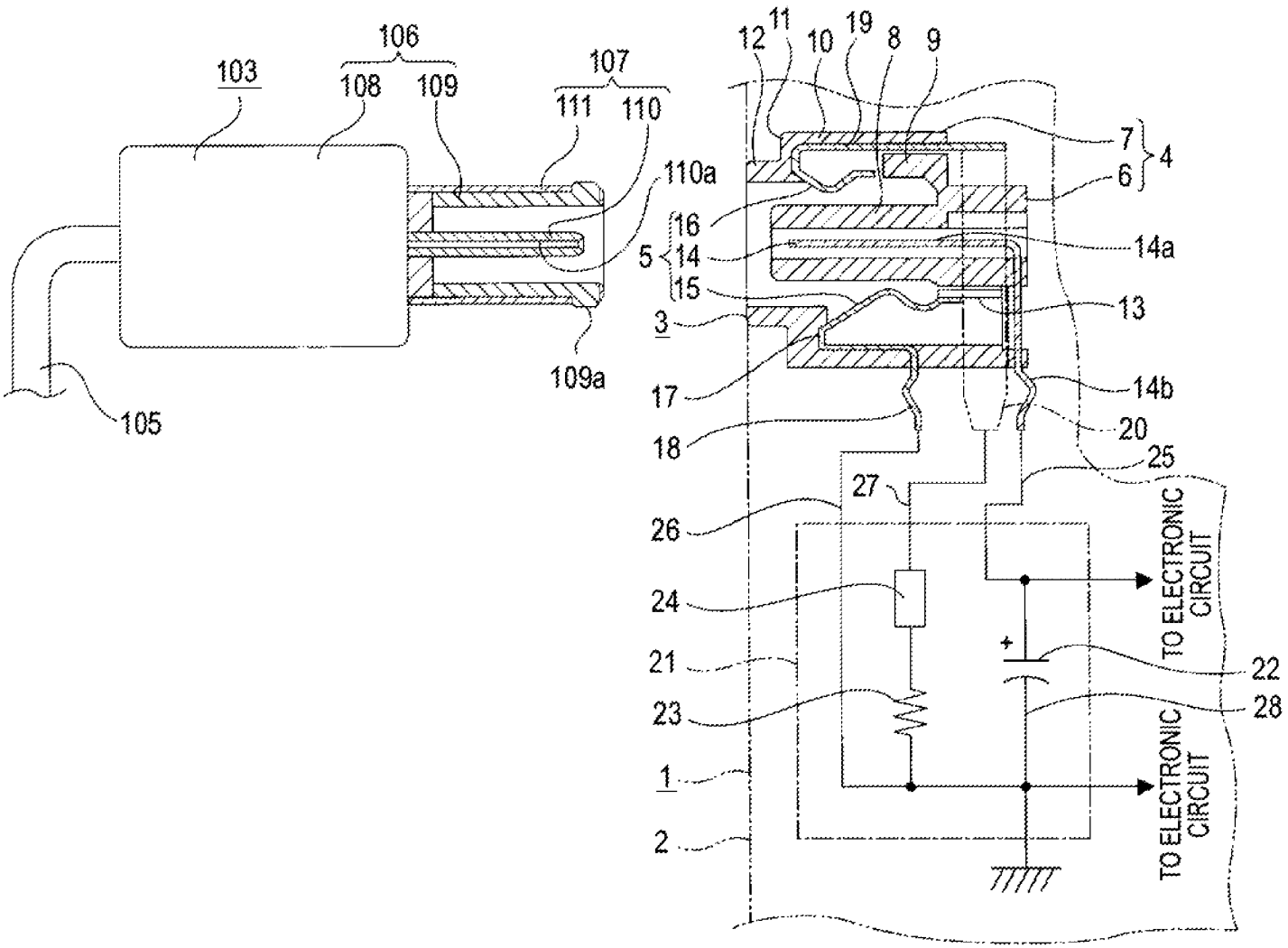
FIG. 2 is a view showing part of a connection plug, the connection jack and a circuit unit in cross-section.
Figure 3:
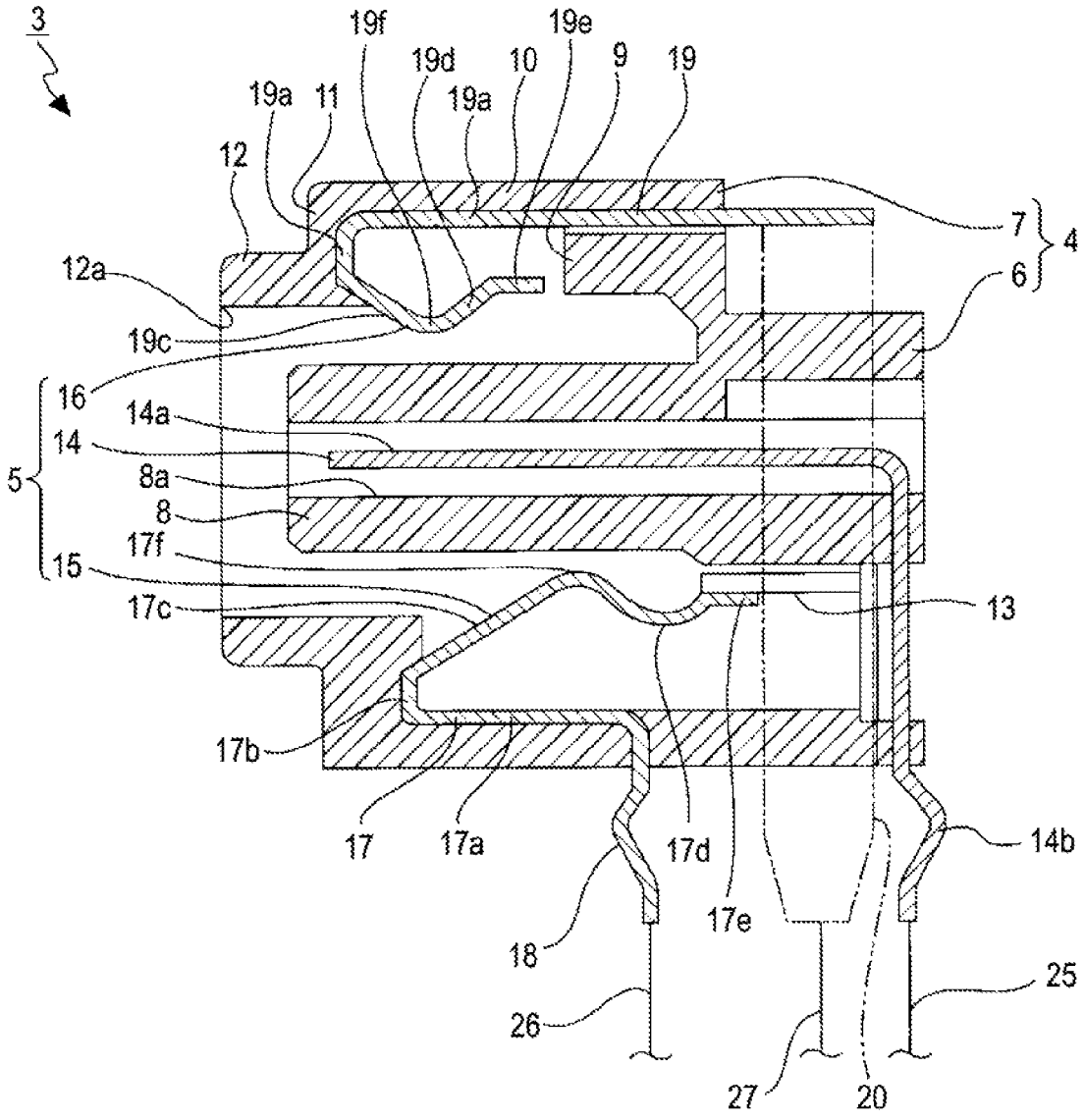
FIG. 3 is an enlarged cross-sectional view of the connection jack.

In the electronic apparatus 1, a circuit unit 21 is provided between the connection jack 3 and the electronic circuit (see FIG. 2). The circuit 21 includes a capacitor (smoothing capacitor) 22, a resistance 23 and a protection device 24.

In the circuit unit 21, a first connection line 25 is connected to the tab portion 14*b* of the center electrode 14, a second connection line 26 is connected to the tab portion 18 of the first earth electrode 15 and a third connection line 27 is connected to the tab portion 20 of the second earth electrode 16. The first connection line 25 and the second connection line 26 are connected to a fourth connection line 28, and the capacitor is connected on the fourth connection line 28. The first connection line 25 and the second connection line 26 are connected to the electronic circuit. The second connection line 26 is grounded.

The resistance 23 and the protection device 24 are connected in series on the third connection line 27 and the protection device 24 is connected on the side of the second earth electrode 16 between the second earth electrode 16 and the resistance 23. The third connection line 27 is connected to the connection line 26.

[Connecting Operation of Connection Plug to Connection Jack]

Hereinafter, an operation performed when the connection plug 103 is connected to the connection jack 3 in a state where the power supply plug 101 of the power supply device 100 is connected to the plug socket 200 will be explained (see FIG. 4 to FIG. 6).

Figure 4:
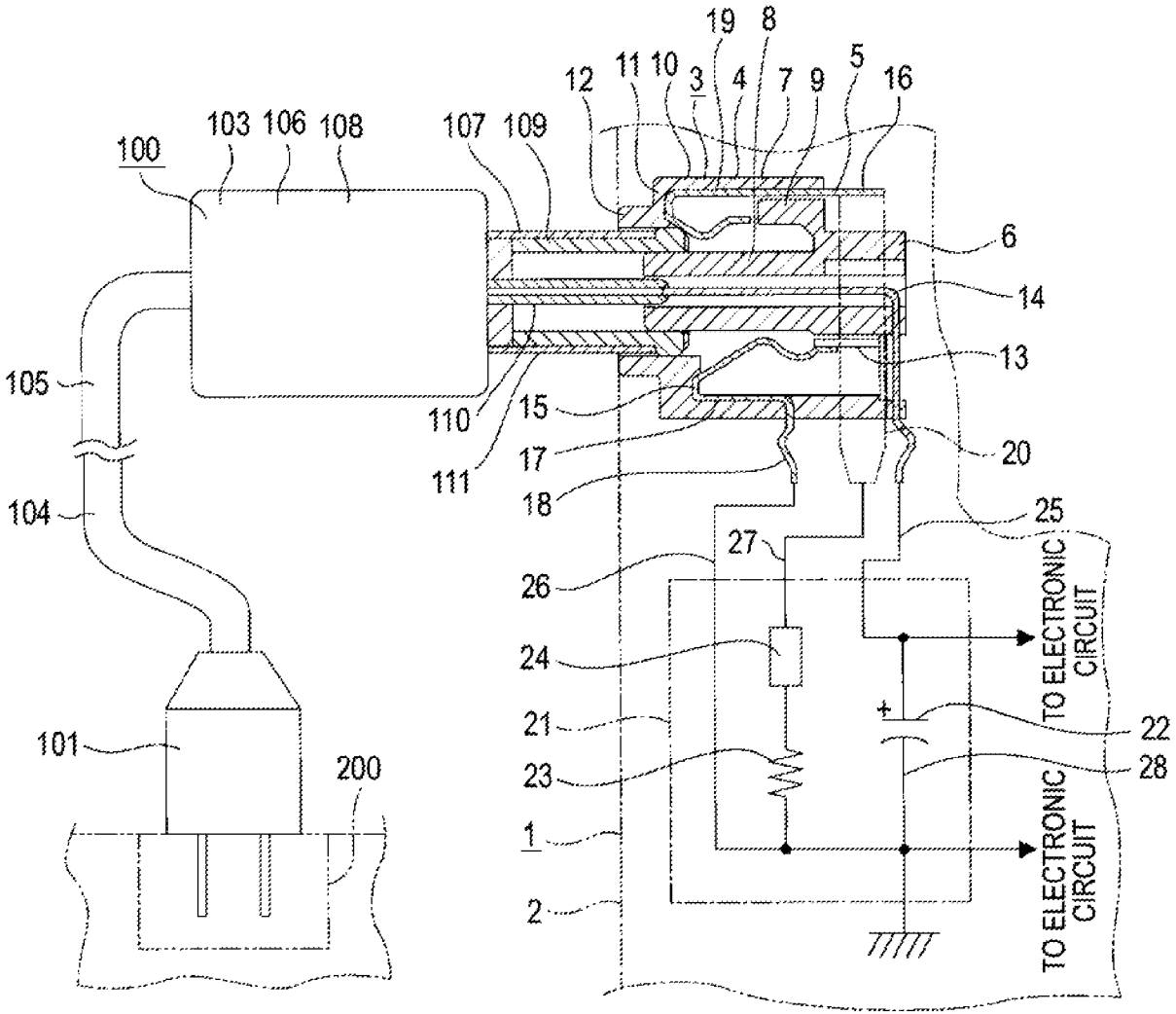
FIG. 4 shows an operation performed when the connection plug is connected to the connection jack together with FIG. 5 and FIG. 6, which is a view showing part of a state where a center terminal is connected to a center electrode in cross section.

First, the connection terminal 107 and the holding protrusion 109 of the connection plug 103 are inserted from the insertion opening 12*a* formed in the housing 4 of the connection jack 3 and the holding protrusion 109 is inserted to the inside of the inner peripheral portion 12 of the outer cylindrical portion 7 (see FIG. 4). At this time, the center terminal 110 is inserted into the insertion arrangement hole 8*a* formed in the center portion 8 of the inner cylindrical portion 6 and the center terminal 110 is connected to the center electrode 14.

Figure 5:
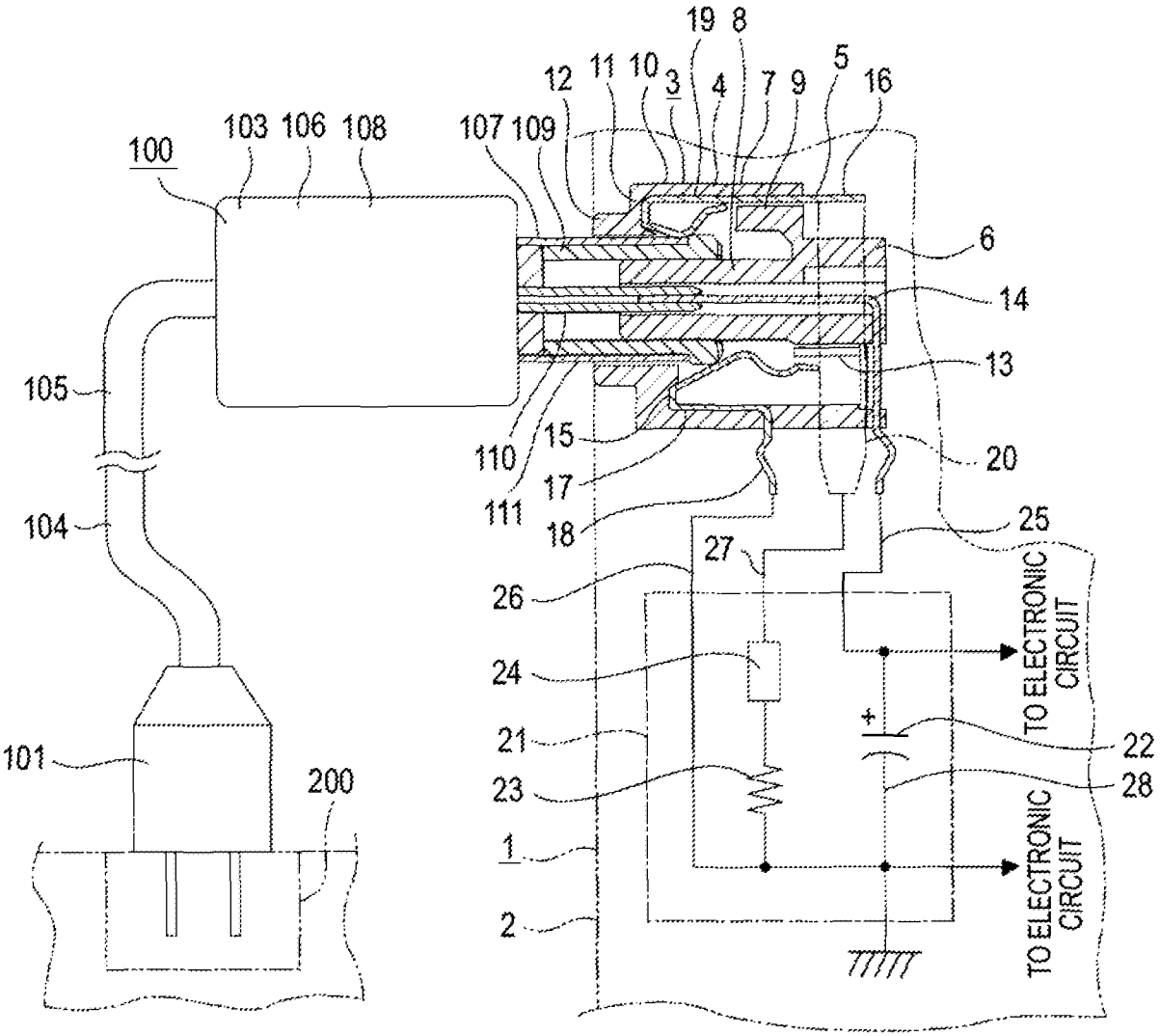
FIG. 5 is a view showing part of a state where an earth terminal is connected to a second earth electrode in cross section.

As the connection plug 103 is further inserted into the connection jack 3, the center electrode 14 is inserted into the connection hole 110*a* of the center terminal 110, the flange portion 109*a* of the holding protrusion 109 slides along the first inclined portion 19*c* of the second earth electrode and the first inclined portion 19*c* and so on are elastically deformed, then, the earth terminal 111 is connected to the contact portion 19*f* (see FIG. 5). The contact portion 19*f* is connected in a state of being pushed onto the earth terminal 111 due to elasticity of the second earth electrode 16. At this time, the flange portion 109*a* slides along the first inclined portion 17*c* of the first earth electrode 15 and the first inclined portion 17*c* and so on are elastically deformed, however, the earth terminal 111 does not touch the contact portion 17*f*. When flange portion 109*a* slides along the first inclined portion 17*c* of the first earth electrode 15 and the first inclined portion 17*c* and so on are elastically deformed, the connection of the contact terminal portion 17*e* with respect to the detection terminal 13 is released, and the insertion of the connection plug 103 to the inside of the connection jack 3 is detected by the detection unit.

When the earth terminal 111 is connected to the contact portion 19*f* of the second earth electrode 16, electric current is supplied to the capacitor 22 and the electronic circuit, and the capacitor 22 is charged.

The charge with respect to the capacitor 22 is performed by electric current flowing in the first connection line 25 and the third connection line 27. Accordingly, the capacitor 22 is charged in a state where a current value is limited by the resistance 23.

Figure 6:
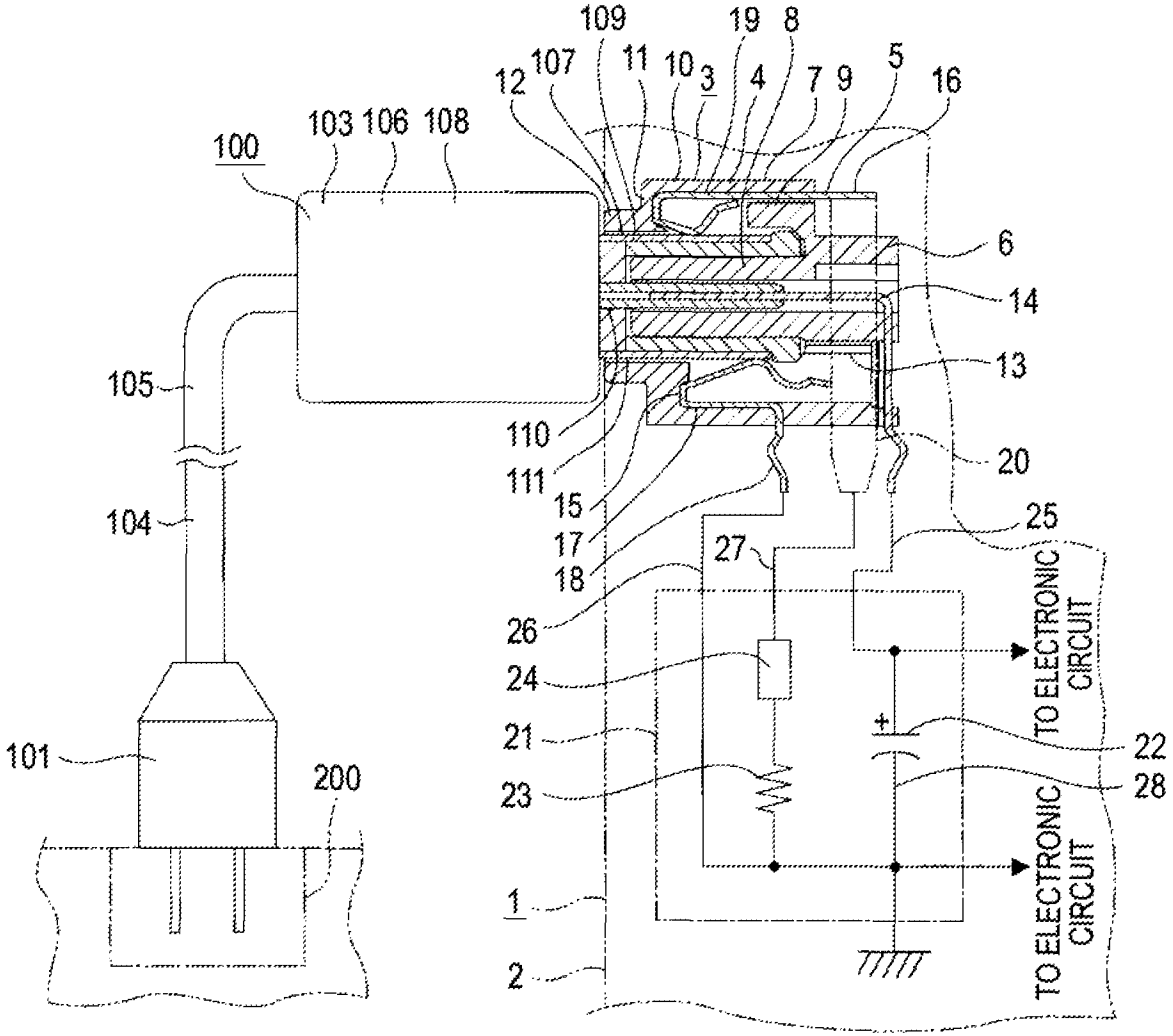
FIG. 6 is a view showing part of a state where the earth terminal is connected to a first earth electrode and connection between the connection plug and the connection jack is completed in cross section.

As the connection plug 103 is further inserted into the connection jack 3, the center electrode 14 is further inserted into the connection hole 110*a* of the center terminal 110, the connection terminal 111 slides onto the contact portion 19*f* of the second earth electrode 16, the flange portion 109*a* of the holding protrusion 109 slides along the first inclined portion 17*c* of the first earth electrode 15 and the first inclined portion 17*c* and so on are elastically deformed, then, the earth terminal 111 is connected to the contact portion 17*f* (see FIG. 6). The connection portion 17*f* is connected in a state of being pushed onto the earth terminal 111 due to elasticity of the first earth electrode 15.

When the earth terminal 111 is connected to the contact portion 17*f* of the first earth electrode 15, the resistance 23 is bypassed and the charge with respect to the capacitor 22 is performed by electric current flowing in the first connection line 25 and the second connection line 26.

In a state where the earth terminal 111 is connected to the contact portion 17*f* of the first contact electrode 15, a rear face of the holding protrusion 109 of the connection plug 103 touches the presser portion 9 of the inner cylindrical portion 6, and it is difficult to further insert the connection terminal 107 and the holding protrusion 109 into the connection jack 3, therefore, the connection of the connection plug 103 to the connection jack 3 is completed.

In the connection operation of the connection plug 103 with respect to the connection jack 3, incomplete connection may occur, in which the earth terminal 111 is connected to the contact portion 19*f* of the second earth electrode 16 but not connected to the contact portion 17*f* of the first earth electrode 15 (see FIG. 5).

In the case where such incomplete connection occurs, excessive supply of electric current to the third connection line 27 is detected by the protection device 24, and the third connection line 27 is cut off and the supply of electric current to the resistance 23 is interrupted. As a result, the supply of electric current to the resistance 23 is suppressed and excessive heat generation in the resistance 23 can be prevented.

In a state where good connection is made between the connection plug 103 and the connection jack 3, a period of time from the connection of the earth terminal 111 to the contact portion 19*f* of the second earth electrode 16 until the connection of the earth terminal 111 to the contact portion 17*f* of the first earth electrode 15 is extremely short, and a heating value in the resistance 23 is extremely low.

As described above, the heating value in the resistance 23 generated when good connection is made between the connection plug 103 and the connection jack 3 is extremely low, moreover, the supply of electric current to the resistance 23 is interrupted by the protection device 24 when the incomplete connection state occurs, thereby preventing excessive heat generation in the resistance 23.

Accordingly, it is not necessary to use a large-capacity resistance withstanding the high heating value and the resistance 23 withstanding the low heating value can be used. The small-capacity resistance 23 can be used by arranging the protection device 24, thereby reducing manufacturing costs of the electronic apparatus 1.

[Brief]

As described above, the connection jack 3 includes the center electrode 14, the first earth electrode 15 and the second earth electrode 16. The first earth electrode 15 and the second earth electrode 16 are arranged at positions where the earth terminal 111 is connected to the second earth electrode 16 connected to the resistance 23 before the earth terminal 111 is connected to the first earth electrode 15 at the time of connecting the connection plug 103.

Accordingly, it is not necessary to provide an inrush-current limiter with a large number of components including a switch in addition to resistances and having high manufacturing costs, therefore, generation of inrush current can be prevented while reducing manufacturing costs and downsizing the apparatus.

As occurrence of inrush current can be prevented, sparks does not occur and occurrence of the sound of sparks can be prevented.

Moreover, the first earth electrode 15 and the second earth electrode 16 can be elastically deformed, and the first earth electrode 15 and the second earth electrode 16 are connected to the earth terminal 111 of the connection plug 103 in the state of being pushed thereon due to elasticity, therefore, a good connection state of the earth terminal 111 with respect to the first earth electrode 15 and the second earth electrode 16 can be secured.

Additionally, as the first earth electrode 15 and the second earth electrode 16 are arranged 180 degrees opposite to each other so as to sandwich the center electrode 14, the first earth electrode 15 and the second earth electrode 16 are connected to the earth terminal 111 from opposite sides so as to sandwich the center thereof, and the connection state of the connection plug 103 with respect to the connection jack 3 can be stabilized.

When the connection plug 103 is connected to the connection jack 3, it is also possible to connect the earth terminal 111 to the second connection electrode 16 before the center terminal 110 is connected to the center electrode 14 at the time of connecting the connection plug 103 to the connection jack 3.

However, the center terminal 110 is connected to the center electrode 14 before the earth terminal 111 is connected to the second earth electrode 16 at the time of connecting the connection plug 103 to the connection jack 3 as described above, thereby allowing the central axis of the earth terminal 111 to correspond to the central axis of the center axis of the center electrode 14 and thereby positioning the connection plug 103 with respect to the connection jack 3 in the radial direction in the state where the center terminal 110 is connected to the center electrode 14.

Accordingly, when the center terminal 110 is connected to the center electrode 14 before the earth terminal 111 is connected to the second earth electrode 16, the central axis of the earth terminal 111 is not displaced with respect to the central axis of the center electrode 14 in the radial direction when the earth terminal 111 is connected to the first earth electrode 15 and the second earth electrode 16, as a result, the earth terminal 111 can be positively connected to the first earth electrode 15 and the second earth electrode 16.

Though the example in which the resistance 23 and the protection device 24 are provided separately from the connection jack 3 has been shown as the above, it is also possible to provide the resistance 23 and the protection device 24 inside the connection jack 3.

[Present Technology]

The technology according to the present disclosure can apply the following configurations.

(1) A connection jack to which a connection plug having a center terminal and an earth terminal arranged on an outer peripheral side of the center terminal is connected and provided in an electronic apparatus in which a capacitor is disposed inside, including a housing made of an insulating material, in which an insertion opening to which the connection plug is inserted is formed, a center electrode to which the center terminal is connected and connected to the capacitor, a first earth electrode arranged on an outer peripheral side of the center electrode, to which the earth terminal is connected, and connected to the capacitor, and a second earth electrode arranged on an outer peripheral side of the center electrode, to which the earth terminal is connected, connected in series to a resistance limiting inrush current and connected to the capacitor through the resistance, in which the first earth electrode and the second earth electrode are arranged at positions where the earth terminal is connected to the second earth electrode before the earth terminal is connected to the first earth electrode at the time of connecting the connection plug.

(2) The connection jack described in the above (1), in which a protection device for protecting the resistance is provided, which suppresses heat generation in the resistance generated when the center terminal is connected to the center electrode and the earth terminal is connected to the second earth electrode in a state where the earth terminal is not connected to the first earth electrode.

(3) The connection jack described in the above (1) or (2), in which the first earth electrode and the second earth electrode can be elastically deformed, and the first earth electrode and the second earth electrode are connected to the earth terminal in a state of being pushed thereon due to elasticity.

(4) The connection jack described in the above any one of (1) to (3), in which the first earth electrode and the second earth electrode are arranged 180 degrees opposite to each other so as to sandwich the center electrode.

(5) The connection jack described in the above any one of (1) to (4), in which the second earth electrode and the center electrode are arranged at positions where the center terminal is connected to the center electrode before the earth terminal is connected to the second earth electrode at the time of connecting the connection plug.

(6) An electronic apparatus including a casing in which a capacitor and an electronic circuit is arranged inside, and a connection jack to which a connection plug having a center terminal and an earth terminal arranged on an outer peripheral side of the center terminal is connected, in which the connection jack includes a housing made of an insulating material, in which an insertion opening to which the connection plug is inserted is formed, a center electrode to which the center terminal is connected and connected to the capacitor, a first earth electrode arranged on an outer peripheral side of the center electrode, to which the earth terminal is connected, and connected to the capacitor, and a second earth electrode arranged on an outer peripheral side of the center electrode, to which the earth terminal is connected, connected in series to a resistance limiting inrush current and connected to the capacitor through the resistance, in which the first earth electrode and the second earth electrode are arranged at positions where the earth terminal is connected to the second earth electrode before the earth terminal is connected to the first earth electrode at the time of connecting the connection plug.

Specific shapes and structures of respective portions shown in the above preferred embodiment of the present disclosure are just examples in embodying the present disclosure, and the technical scope of the present disclosure should not be limitedly interpreted by these examples.

It should be understood by those skilled in the art that various modifications, combinations, sub-combinations and alterations may occur depending on design requirements and other factors insofar as they are within the scope of the appended claims or the equivalents thereof.

What is claimed is:

1. A connection jack connectable with a connection plug having a center terminal and an earth terminal arranged on an outer peripheral side of the center terminal and arrangable in an electronic apparatus having a capacitor and a resistance for limiting inrush current disposed therein, said connection jack comprising:

a housing, made of an insulating material, having an insertion opening to which the connection plug is insertable;

a center electrode; and a first earth electrode and a second earth electrode each arranged on an outer peripheral side of the center electrode;

wherein when the connection jack is arranged in the electronic apparatus and the connection plug is connected with the connection jack (i) the center electrode is connected to the center terminal and to the capacitor, (ii) the first earth electrode is connected to the earth terminal and to the capacitor, and (iii) the second earth electrode is connected to the earth terminal, connected in series to the resistance, and connected to the capacitor through the resistance, and wherein the first earth electrode and the second earth electrode are arranged at positions such that the earth terminal is connected to the second earth electrode before the earth terminal is connected to the first earth electrode at the time of connecting the connection plug.

2. The connection jack according to claim 1, wherein the electronic apparatus includes a protection device for protecting the resistance, which suppresses heat generation in the resistance generated when the center terminal is connected to the center electrode and the earth terminal is connected to the second earth electrode in a state where the earth terminal is not connected to the first earth electrode.

3. The connection jack according to claim 1, wherein the first earth electrode and the second earth electrode are configured to be elastically deformable.

4. The connection jack according to claim 1, wherein the first earth electrode and the second earth electrode are arranged 180 degrees opposite to each other.

5. The connection jack according to claim 1, wherein the second earth electrode and the center electrode are arranged at positions where the center terminal is connected to the center electrode before the earth terminal is connected to the second earth electrode at the time of connecting the connection plug.

6. An electronic apparatus comprising:

a casing having an electronic circuit arranged therein, said electronic circuit having a capacitor and a resistance for limiting inrush current; and a connection jack connectable with a connection plug having a center terminal and an earth terminal arranged on an outer peripheral side of the center terminal, wherein the connection jack includes a housing, made of an insulating material, having an insertion opening to which the connection plug is insertable;

a center electrode; and a first earth electrode and a second earth electrode each arranged on an outer peripheral side of the center electrode;

in which when the connection plug is connected with the connection jack (i) the center electrode is connected to the center terminal and to the capacitor, (ii) the first earth electrode is connected to the earth terminal and to the capacitor, and (iii) the second earth electrode is connected to the earth terminal, connected in series to the resistance, and connected to the capacitor through the resistance, and in which the first earth electrode and the second earth electrode are arranged at positions such that the earth terminal is connected to the second earth electrode before the earth terminal is connected to the first earth electrode at the time of connecting the connection plug.

* * * * *